US005467993A

United States Patent [19]

Higginson

[11] Patent Number: 5,467,993

[45] Date of Patent: Nov. 21, 1995

[54] GOLF TRAINING APPARATUS

[76] Inventor: Norman Higginson, 44 Wigshaw Lane Culcheth, Warrington Cheshire, WA3 4NB, Great Britain

[21] Appl. No.: 979,858

[22] PCT Filed: Aug. 29, 1991

[86] PCT No.: PCT/GB91/01454

§ 371 Date: Jun. 15, 1994

§ 102(e) Date: Jun. 15, 1994

[87] PCT Pub. No.: WO92/04082

PCT Pub. Date: Mar. 19, 1992

[30] Foreign Application Priority Data

Aug. 31, 1990 [GB] United Kingdom ..... 9019055

[51] Int. Cl.[6] ..... A63B 69/36

[52] U.S. Cl. ..... 273/191 A

[58] Field of Search ..... 273/191 R, 191 A, 273/192, 191 B, 186.1, 186.2

[56] References Cited

U.S. PATENT DOCUMENTS

| | | | |
|---|---|---|---|
| 1,567,530 | 12/1925 | MacNaughton et al. | 273/191 A |
| 1,960,787 | 5/1934 | MacStocker | 273/191 A |
| 3,319,963 | 5/1967 | Corkburn | 273/191 R X |
| 3,730,531 | 5/1973 | Zega | 273/191 A |
| 3,794,329 | 2/1974 | Wilson | 273/191 A |
| 3,795,399 | 3/1974 | Beckish | 273/191 A |

FOREIGN PATENT DOCUMENTS

| | | | |
|---|---|---|---|
| 312287 | 4/1989 | European Pat. Off. | 273/191 A |
| 597724 | 2/1948 | United Kingdom | 273/191 R |
| 1258446 | 12/1971 | United Kingdom | 273/191 A |
| WO82/01471 | 5/1982 | WIPO | 273/191 A |

*Primary Examiner*—George J. Marlo

*Attorney, Agent, or Firm*—Pravel, Hewitt, Kimball & Krieger

[57] ABSTRACT

A guide track (10) in the form of a flat or angled strip of looped configuration, representing a golf club swing path, is pivotally adjustably mounted between spaced side supports (12, 13), which are height adjustable, independently of said pivotal adjustment. A carriage (C), slidably mounted on the track (10) is provided with means (D) for attachment of a golf club shaft (S) including an elongate member (40) which is axially adjustable relative to the carriage (C) in a direction transverse to the track (10).

By allowing for three levels of adjustment, namely of track inclination, track height and shaft position transversely of the track (radially in the case of a circular track) the apparatus can very easily be adjusted to simulate the ideal swing path for anyone with normal ranges of stature within a matter of minutes.

21 Claims, 6 Drawing Sheets

10
16
13
15
D
S
40
38
29
14
14
35
17
28
C
34
36
26
27
19
20
25
3
32
3
31
30
23

GOLF TRAINING APPARATUS

RELATED APPLICATIONS

This is application is a U.S. national patent application, under 35 U.S.C. §371, of PCT Application GB91/01454 filed Aug. 29, 1991, and claims priority from that application.

TECHNICAL FIELD

This invention relates to golf training apparatus.

Everyone familiar with the game of golf appreciates the importance of proficient and consistent swinging of a golf club for achieving drives of long distance and hence success in the game. A good swing depends on several factors including the initial posture of the golfer's body, the movement of the body during the swing and the path of the golf club itself.

BACKGROUND ART

Apparatus enabling a golfer to become familiar with an ideal swing path and proficient at performing same has been proposed which comprises a rail or track held in a looped configuration representing an ideal golf club swing path, and a carriage-slidably mounted on the rail for attachment of the shaft of a golf club.

When a golfer fastens his club to the carriage and stands centrally within the area defined by the looped rail and swings the club, the carriage should slide freely along the rail with the club attached thereto following the path set by the position of the rail.

Many variations of this concept have been disclosed in prior patent specifications, such as GB 1174773, GB 1258446, U.S. Pat. No. 2,653,025 U.S. Pat. No. 3,794,329, U.S. Pat. No. 4,280,701 and WO82/01471, as well as the applicant's own prior specification GB 2210798, but such apparatus, if ever commercially available, has never proved successful. This may be accounted for by practical difficulties in two areas, namely the ease and speed of adjustment of the rail or track to suit users of different stature, and the smooth running of the carriage on the rail or track, the latter sometimes also being affected (possibly adversely) upon adjustment of the rail or track. In this respect, since the high cost of such apparatus dictates that it will mainly be used by golf instructors at clubs its rapid ajustability to suit different players under tuition is essential, as is its reliable functioning.

OBJECT OF INVENTION

The object of the present invention is to provide improved apparatus of this type wherein both the inclination of the plane of the looped rail or track and its overall height can be adjusted through a wide range, to suit all possible statures, in a matter of minutes, and wherein free sliding of the carriage on the rail is assured.

SUMMARY OF INVENTION

According to the present invention golf training apparatus comprises spaced side support means, which are height adjustable relative to base elements, a guide track in the form of a flat or angled strip of looped configuration, representing a golf club swing path, which is pivotally mounted between the side support means for pivotal adjustment relative thereto, independent of their height adjustment, and a carriage which is slidably mounted on the track, having bearing means for contacting opposing surfaces of the guide track, and which is provided with means for attachment of a golf club shaft including an elongate shaft-connecting member, which is axially adjustable relative to the carriage in a direction transverse to the track.

The track most conveniently consists of a flat strip, as that is simplest to manufacture and minimises complexity of carriage construction, and most importantly is less likely than any other form of track to result in problems of distortion or unevenness which could hinder free sliding of the carriage. However, a track of angular cross-section, may also prove suitable.

Furthermore, the track advantageously consists of a continuous closed loop configuration in one plane. Again, that simplifies manufacture and minimises complexity which could give rise to problems, upon adjustment, in free running of the carriage. Moreover, it results in a particularly robust construction, with potential for mechanical faults minimised. It has been found that such configuration is in no way detrimental to simulation of an ideal swing path. In practical embodiments the track shape may advantageously approximate to a circle, and in cases where the track is a flat strip, the major surfaces thereof are preferably perpendicular to the plane of the track.

In practical embodiments the side support means may advantageously consist of respective sub frames, eg. of triangular configuration, which are particularly high in mechanical strength, rigidity and stability.

Height adjustment of each side support relative to its base element may advantageously be accomplished by way of a mechanism including a pair of obliquely extending beams which pivotally intersect intermediate their ends so as to vary their relative angular dispositions (in scissor like manner).

Additionally or alternatively height adjustment of each side support relative to its base element may advantageously be accomplished by a mechanism which includes threadedly interengaged parts, one of which is held against rotation and is displaceable relative to the other upon rotation of the latter.

Furthermore, mechanisms for height adjustment of the respective side support means are advantageously interconnected for simultaneous actuation.

In practical embodiments the height adjustment mechanisms may be encased within respective telescopic casings, for safety and aesthetic reasons.

The respective base elements are advantageously interconnected so as to enhance the stability of the structure.

The apparatus preferably includes means for holding the looped track in selected angular positions relative to the side supports means. Such means may conveniently comprise one or more elongate members pivotally connected to the track and provided with a row of apertures or notches whereby it can be secured relative to the side support means. In preferred practical embodiments such an elongate member is provided on a frame structure which is fixedly attached to the lower region of the looped track, and is selectively securable to a cross piece extending between the side support means.

The carriage may comprise at least two parts, each provided with bearing means, the two parts either being hingedly adjustable relative to each other, but fixed at an appropriate relative angle in use, or remaining freely swingable relative to each other during use.

It is possible, however, that the carriage may be designed in one piece, despite problems in achieving the necessary precision in shape to ensure trouble free sliding around the track in all circumstances.

In preferred practical embodiments, the carriage consists of three parts, namely a bridging part and respective end parts, provided with the bearing means, hingedly connected to each end thereof. The axially adjustable, elongate, shaft connecting element is then conveniently mounted on said bridging part, for adjustment relative thereto. In this respect the bridging part may be provided with a tunnel or passageway through which the elongate member extends and relative to which it is securable at any selected position.

A connection device, whereby the golf club shaft is fastened onto the axially adjustable, elongate, shaft-connecting element, is provided and is preferably constructed so as to allow rotation of the shaft about its own axis, pivoting of the shaft in the plane of the track and rocking of the shaft relative to said plane.

BRIEF DESCRIPTION OF DRAWINGS

A preferred practical embodiment in accordance with the invention will now be described with reference to the accompanying drawings, in which.

DETAILED DESCRIPTION OF ILLUSTRATED EMBODIMENT AND VARIANTS

Figure 1:
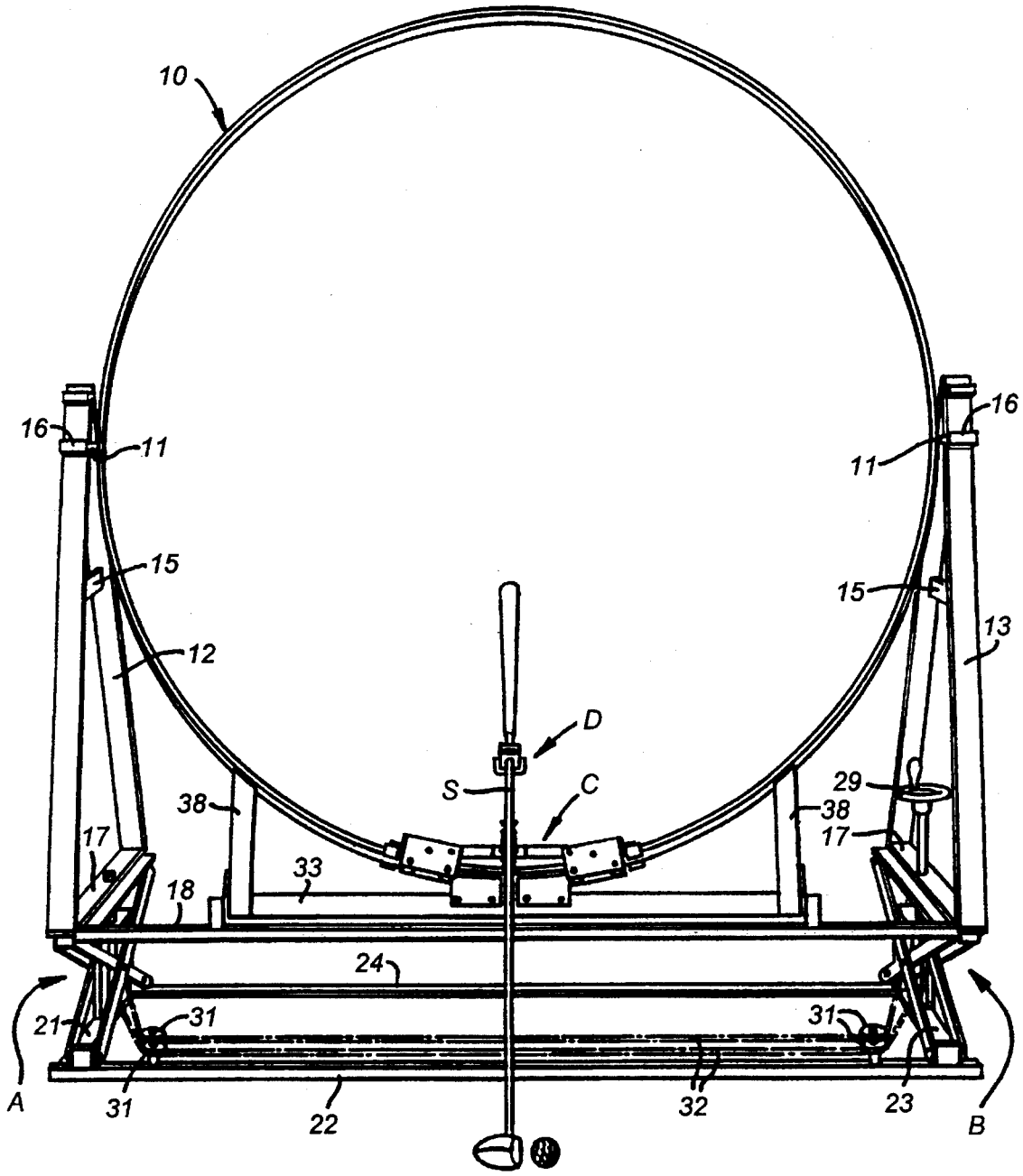
FIG. 1 is a front view of the exemplary apparatus with golf club attached.
Figure 2:
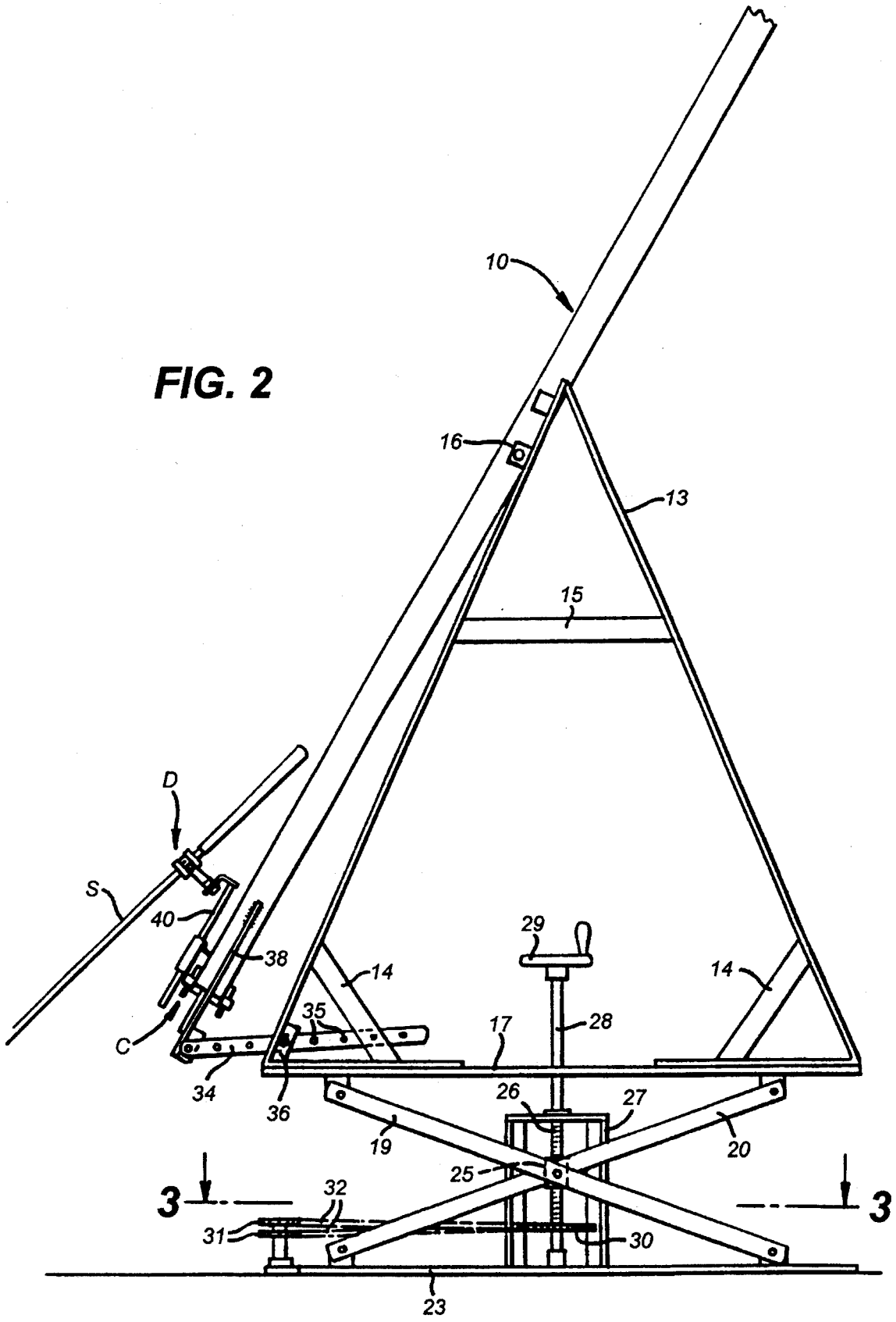
FIG. 2 is an enlarged, fragmentary side view of the same apparatus, from the right hand side of FIG. 1.
Figure 3:
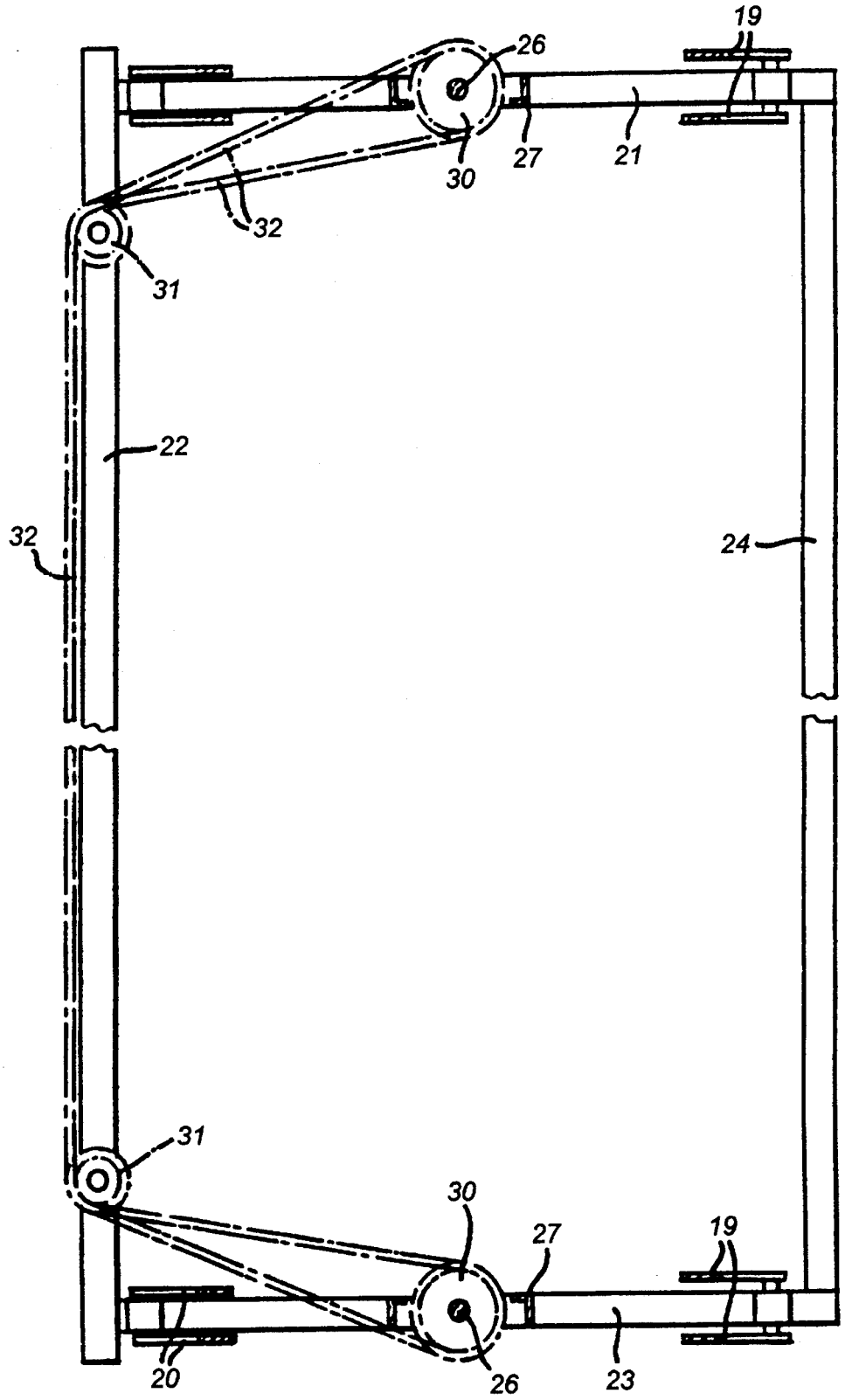
FIG. 3 is a section along the line III—III in FIG. 2 in the direction indicated.

Referring firstly to FIGS. 1 and 2, this preferred practical embodiment comprises a guide track 10 which is substantially circular and consists of a continuous flat strip of metal with major surfaces perpendicular to the plane of the circle. Suitably, the track may have a circumference of approx 520 cm, a diameter of approximately 165 cm, a thickness of approximately 6.5 mm and a width of approximately 7.5 cm. The track 10 is pivotally mounted, by pins 11 at diametrically opposing positions, between respective side supports in the form of triangular subframes 12, 13, also formed of flat strips of metal with major surfaces perpendicular to the planes of the respective subframes. Reinforcing cross-struts 14, 15 enhance the strength and rigidity of these subframes 12, 13. It will be noted that the pins 11 are journalled in bearings 16 near the apex of each subframe. The lower transverse members 17 of the subframes 12, 13 are joined at the front by a crosspiece 18. The subframes 12, 13 and the crosspiece 18 are mounted above a rectangular frame consisting of four base elements 21 to 24 which form the four sides thereof (see FIG. 3) by respective height adjustment mechanisms, designated generally A and B in FIG. 1, disposed between the base elements 21 and 23 and the lower transverse members 17 of the subframes 12, 13.

One of the height adjustment mechanisms is shown in more detail in FIG. 2. It consists of a pair of obliquely extending beams 19, 20 which intersect approximately at their respective midpoints where both are pivotally mounted upon a block 25, and which are each pivotally connected at their respective ends to the lower transverse member 17 of the respective subframe 13 and to the respective base element 23 therebelow. The pivot block 25 is threadedly engaged on an upright threaded shaft 26 which is journalled in a fixed support structure 27 and extends upwardly therefrom through a cylindrical sleeve 28, which itself extends through transverse member 17, to terminate in an actuator in the form of a wheel 29. Since the pivot block 25 is constrained against rotation by connection of the two beams 19, 20, rotation of the shaft 26, by means of actuator 29, causes it to move up and down upon the shaft 26 thus raising and lowering the subframe 13.

A sprocket 30 is fixed to each threaded shaft 26 adjacent the lower end thereof and a belt or chain 32 is conducted around these by way of further sprockets 31 mounted at the front corner of the basal frame 21 to 24. In this way simultaneous and equal raising and lowering of both subframes 12, 13 is accomplished by actuation of only one wheel 29 (FIG. 1).

Although not illustrated, the respective sets of oblique, pivotal beams 19, 20, may be boxed in by telescopic casing means mounted from the member 17 and the base element 23 respectively, to prevent any interference with the height adjustment mechanism and/or for general safety and aesthetic reasons.

Attached to the lower region of the track 10 is a frame structure consisting of two parallel arms 38, connected by a longer cross piece 33, the latter extending parallel to a tangent of the circle and parallel to the crosspiece 18 from which it has a narrow clearance. At the end of each arm 38, where connected to the crosspiece 33, a respective rearwardly directed elongate bar 34 is pivotally connected. Each bar 34 has a row of apertures 35 therein (FIG. 2) and projects above the crosspiece 18, for engagement with a respective bracket 36 on each subframe 12, 13 by a bolt through any selected one of the apertures. In this way, once the track 10 has been pivoted to an appropriate angle of inclination of its plane relative to the subframes 12, 13 it can be securely held by the bolting of one or both of the bars 34 to the respective brackets 36 using the relevant one of the apertures 35.

Alternatively, a plurality of spaced notches could be provided in the bar 34 in place of the apertures 35 for simple hooked engagement of a projection on the bracket 36.

A carriage, designated generally by reference C in FIGS. 1 and 2, is slidably mounted on the track 10. An elongate shaft-connecting rod 40 is mounted on the carriage C in axially adjustable manner and carries a connection device D, whereby a golf club shaft S is fastened. Details of the carriage C and associated parts are shown in FIGS. 4 to 6.

As shown, the carriage C comprises a central bridging section 41, consisting simply of a pair of narrow bars, to each end of which a respective end section 42, 43 is hingedly connected by pins 57. The end sections 42, 43 are symmetrical with respect to their connection to the bridging section 41. Each end section 42, 43 consists of parallel plates 44 spaced apart at one end by the hinge pin 57 connecting the bridging section 41, at the other end by a spacing strut 45, and at an intermediate position by a roller 46. When the carriage is mounted on the track 10, the plates 44 lie at either side of the track (their planes generally parallel to the plane of the circle) spaced from each narrow track edge by respective rollers 47 which are mounted on the cross strut 45 and bear against said edges. The connecting roller 46 bears against the inner face of the track 10, whilst two pairs of wheels 48 mounted inwardly of each plate 44 bear against the other face of the track 10.

The construction of the carriage in two parts which hinge relative to each other has been found, in practice, to be particularly advantageous in ensuring free running of the carriage, ie. minimal risk of jamming or unevenness in carriage displacement, which could result in injury to the user, in addition to general inconvenience. It should be noted, however, that the pivotal connections between the end sections 42, 43 and the bridging section 41, by way of the pins 57, need not mean that these sections are left freely swingable relative to each other. They may simply be adjustable, as required, with bolts or nuts associated with the pins being tightened to fix them rigidly in their chosen relative positions for free sliding of the carriage prior to use of the apparatus. Readjustment at any time would, of course readily be achieved by loosening those bolts or nuts again.

Figure 4:
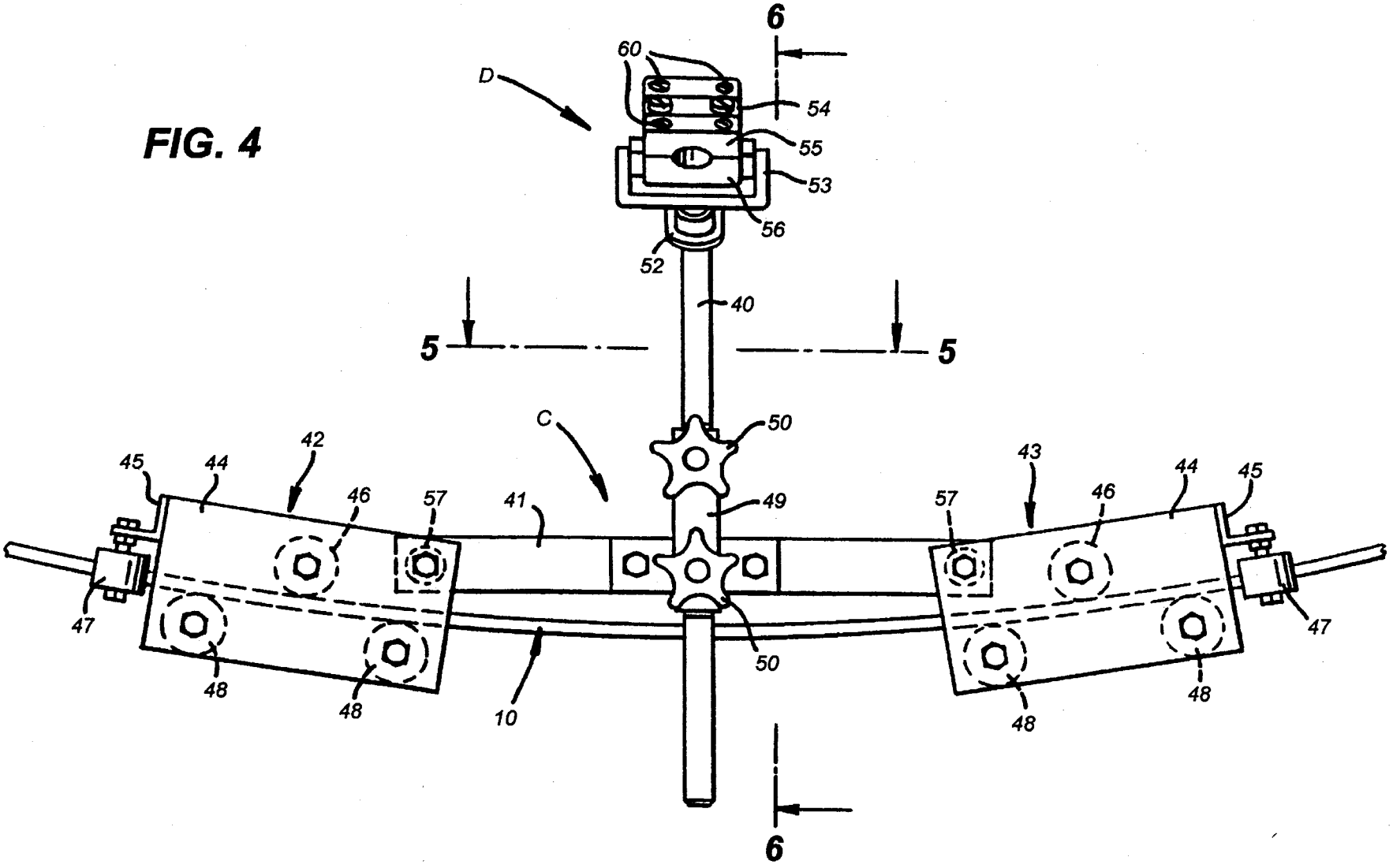
FIG. 4 is an enlarged detail of the carriage, when mounted on the track, as in FIG. 1.
Figure 5:
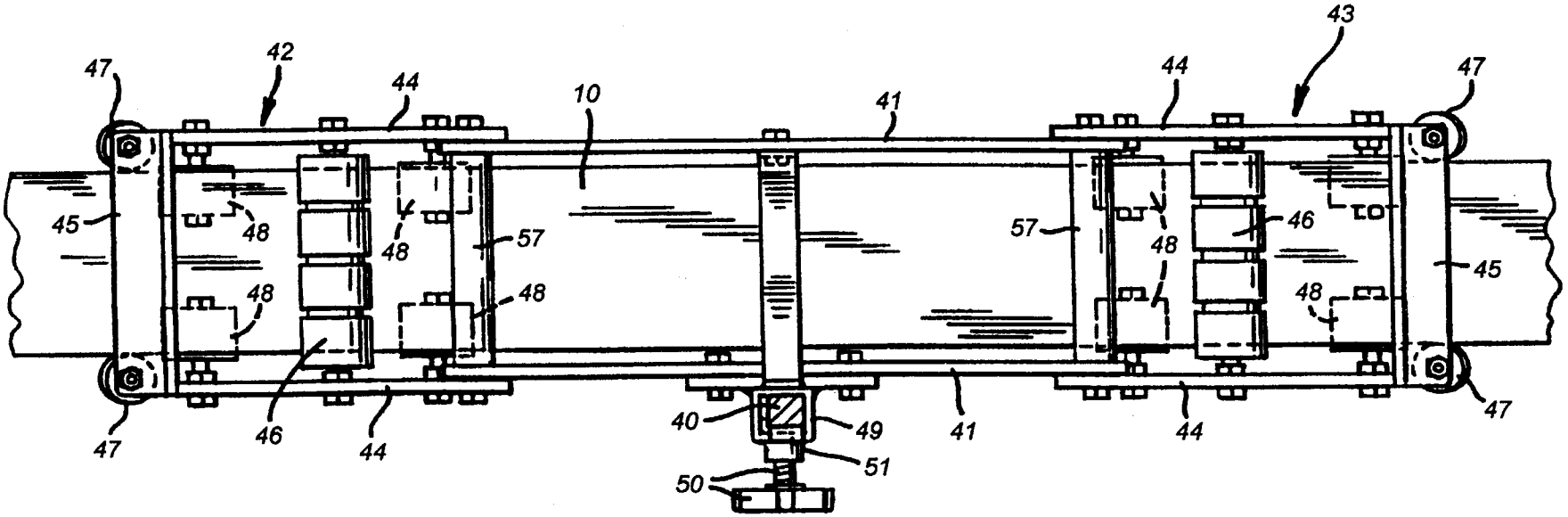
FIG. 5 is a view on line V—V in FIG. 4, in the direction indicated.
Figures 6, 7:
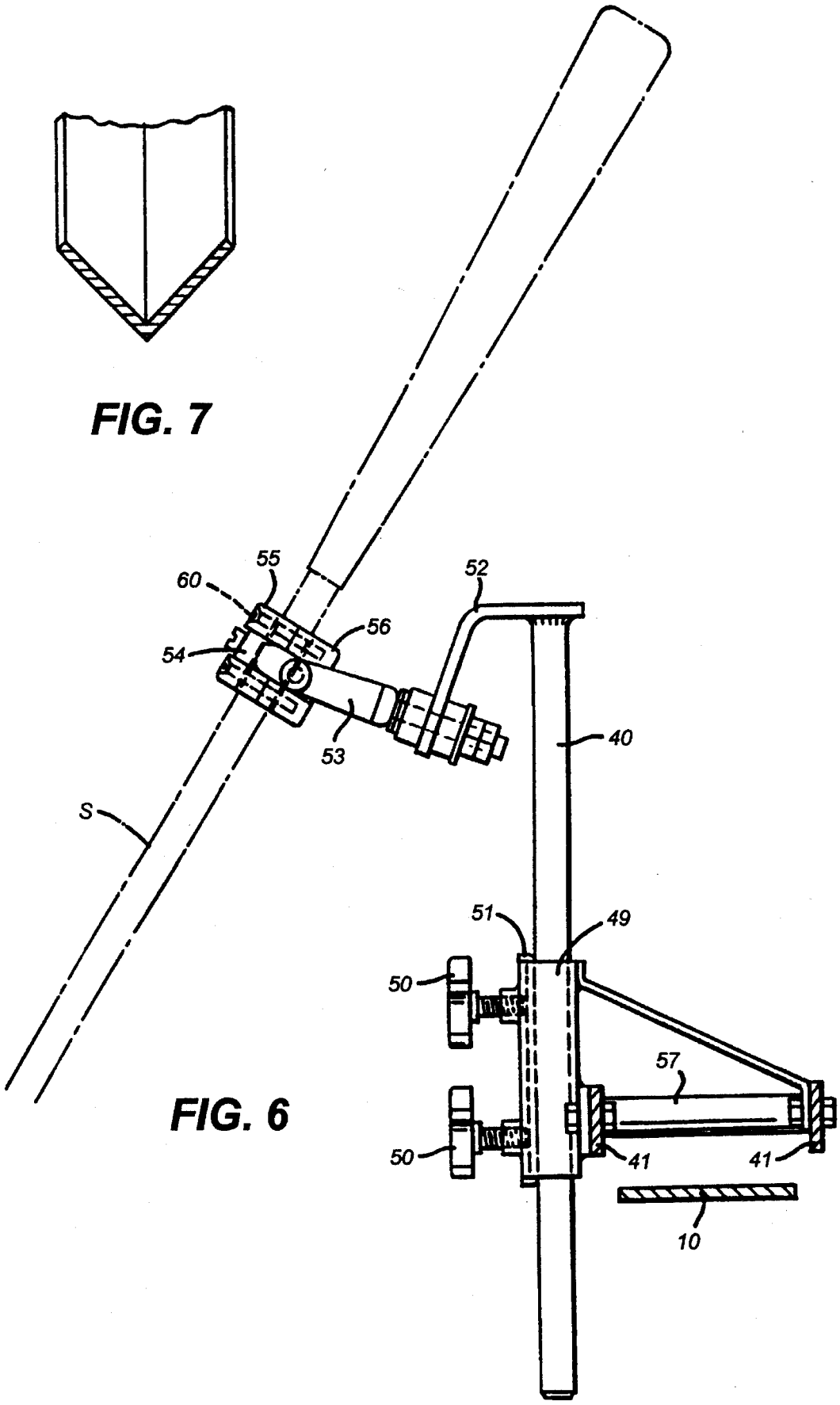
FIG. 6 is a view on line VI—VI in FIG. 4 in the direction indicated.
FIG. 7 is a fragmentary perspective section of a modified track profile.

The shaft-connecting rod 40 extends through a passageway defined by a channel section 49 which is fixed centrally to the bridging section 41 as shown in FIGS. 4 and 6. The channel section 49 extends perpendicularly relative to the bridging section 41 and radially with respect the circular track 10. The rod 40 is a sliding fit in the channel section 49 and is axially adjustable by virtue of retaining screws 50, which hold it in any selected axial position by pressure on an associated strip 51, which is retained within the passageway by having upturned ends.

The device D is connected to the radially inner end of the rod 40 by an angled connector tab 52. A stirrup connector 53 is rotatably connected to the tab 52 and provides a pivot shaft for the pivotal mounting of block 54, which retains a rotatable clamping arrangement. The latter consists of matching clamp parts 55, 56, which together define a cylindrical channel portion, extending through the block 54 and retained by enlarged rectangular end portions, in which channel the golf club shaft S can be non-rotatably gripped. As mentioned, the clamp parts 55, 56 are capable of rotation relative to the central block 54, but the latter prevents relative axial movement of the clamp parts 55, 56 and hence of the shaft S, once the latter is firmly clamped in by tightening of the screws 60 holding the clamp parts together.

When the apparatus is to be used, a user's golf club is fastened to the device D by releasing the respective clamps parts 55, 56 and resecuring these around the shaft S of the club. The shaft S is then securely held and is not axially moveable. The bars 34 are released and the angle of inclination of the track 10 appropriate to the stature of the user is ascertained (by trial and error) by pivoting the track on the pins 11. Once this is settled, the bars 34 are secured to hold the track 10 at the selected angle relative to the side frames 12, 13. The height of the track 10 is then independently adjusted, by turning the or one of the wheels 49 to raise or lower the side frames 12, 13 which support the track 10. In this respect a maximum range of adjustment of between 15 and 20 cm should be adequate to cater for the vast majority of potential users falling between about 5 ft 3 ins (1 m 60 cm) and 6 ft 3 ins (1 m 90 cm) in height, since further adjustment to cater for differences in reach is effected by displacement of the rod 40, which is then secured in its selected position by the screws 50. The rod 40 should also have a maximum axial adjustment of between 15 and 20 cm.

It is important to note that after adjustment, in turn, in each of these three respects, the apparatus is secured, i.e. fixed, in the selected position. Thus the track height and inclination are fixed, the golf club shaft S is secured in the clamp so that it is not axially moveable, and the rod 40 is fixed in position relative to the carriage. The swing path is thus set so that the golfer gets used to it by practicing.

A scale is provided adjacent the side support lower members 17, or on the casing of the height adjustment mechanism, and a further scale is provided on the rod 40 for sealing off relative to the channel 49 so that once the apparatus is adjusted for one particular user, scale readings can be noted, along with the number of the aperture or notch used for adjusting the angle of inclination of the track, so that the same positions can readily be re-established for that user another time.

The three levels of adjustment—of track inclination, track height, and shaft position transversely (radially) of the track loop are found to be sufficient to enable the apparatus to be adapted to the swing path of almost anyone within the normal range of stature variation, and it will be appreciated that each adjustment can be accomplished very quickly and easily indeed by way of the bars 34, one of the actuator wheel 29 and the screws 50, respectively. In fact adjustment in all respects may take as little as one minute to accomplish.

The above described embodiment, whilst practically favoured must be seen as illustrative and not limitative of the scope of the invention. Many variations in details (of materials, dimensions and structure) are possible. Moveover, it should be noted in particular that the track need not be circular, and could be ovoid, or an open (not continuous) loop, with or without end regions connected in some other way. Also, the track need not necessary lie in a level plane. Also, as an alternative to a flat strip, the track could have an angled profile, eg. as shown in FIG. 7, with the construction of the carriage modified accordingly to fit thereto. The carriage itself might be formed in one piece, or even if formed as two or more articulating pieces may be of somewhat different design, with different numbers and arrangements of rollers, compared to the carriage in the exemplary illustrated embodiment.

I claim:

1. A golf training apparatus comprising:

(i) spaced side support means mounted on base elements and height adjustable relative to the base elements;

(ii) a guide track of looped configuration pivotally mounted between the side support means, the looped configuration of the guide track defining a golf club swing path;

(iii) means for pivotally adjusting the guide track relative to the side support means, independent of height of the side support means;

(iv) a carriage slidably mounted on the guide track, the carriage comprising bearing surfaces contacting opposite surfaces of the guide track; and (v) means for holding a golf club shaft, said means comprising an elongate shaft connecting member axially adjustably connected to the carriage.

2. The apparatus of claim 1, wherein the track comprises a flat strip of looped configuration.

3. The apparatus of claim 1, wherein the guide track comprises an angled strip of looped configuration.

4. The apparatus of claim 1, wherein the side support means comprise opposing subframes of triangular configuration.

5. The apparatus of claim 1 further comprising a height adjustment mechanism for adjusting the height of the side support means, the mechanism comprising a pair of obliquely extending beams each having a first end and a second end, the beams pivotally intersecting intermediate said ends in a scissor-like manner with the first ends horizontally opposing each other and fixed in relation to the side support means so that height of the side support means is adjusted by movement of the beams in a scissor-like manner.

6. The apparatus of claim 1 further comprising threadedly interengaged parts, one of said parts being fixed in relation to the obliquely extending beams and the other rotatable relative to the fixed part, rotation of the rotatable part moving the obliquely extending beams in a scissor-like manner to adjust the height of the side support means.

7. The apparatus of claim 1 further comprising means for holding the looped track in a fixed angular position relative to the side support means, said means for holding comprising elongate members pivotally connected to the track and provided with a row of apertures for securing the elongate member in a fixed position relative to the side support means.

8. The apparatus of claim 7, wherein the elongate members pivotally connected at the track are located on a frame structure, the frame structure being fixedly attached to the looped track and securable to a cross piece extending between the side support means.

9. The apparatus of claim 1, wherein the carriage further comprises at least two parts, each of said parts comprising bearing means interengaged with the looped track and each part being hingedly adjustable relative to the other.

10. The apparatus of claim 9, wherein the carriage further comprises an elongate bridging part intermediate the two carriage parts.

11. The apparatus according to claim 10, wherein the bridging part comprises a tunnel through which the axially adjustable elongate shaft-connecting member extends and a means for securing the elongate member at a selected height relative to the bridging part.

12. The apparatus of claim 11 further comprising a connection device for connecting a golf club shaft onto the axially adjustable elongate shaft-connecting element, the connection device allowing rotation of the shaft about its own axis, pivoting of the shaft in a plane of the track, and rocking of the shaft relative to said plane.

13. The apparatus of claim 1, wherein the carriage further comprises at least two parts, each of said parts comprising bearing means interengaged with the looped track and each part being freely swingable relative to the other.

14. The apparatus of claim 13, wherein the carriage further comprises an elongate bridging part intermediate the two carriage parts.

15. The apparatus according to claim 14, wherein the bridging part comprising a tunnel through which the axially adjustable elongate shaft-connecting member extends and a means for securing the elongate member at a selected height relative to the bridging part.

16. The apparatus of claim 15 further comprising a connection device for connecting a golf club shaft onto the axially adjustable elongate shaft-connecting element, the connection device allowing rotation of the shaft about its own axis, pivoting of the shaft in a plane of the track, and rocking of the shaft relative to said plane.

17. A golf training apparatus comprising:

(i) spaced side support means mounted on base elements and height adjustable relative to the base elements;

(ii) a guide track of looped configuration pivotally mounted between the side support means, the looped configuration of the guide track defining a golf club swing path;

(iii) means for pivotally adjusting the guide track relative to the side support means, independent of height of the side support means;

(iv) a carriage comprising at least two parts, each of said parts comprising bearing means interengaged with the guide track, and an elongate bridging part intermediate the two carriage parts;

(v) an axially adjustable elongate shaft-connecting element mounted on the bridging part, the bridging part comprising a tunnel through which the elongate element extends, and a means for securing the elongate element at a selected height relative to the bridging part; and (vi) means for connecting a golf club shaft onto the axially adjustable elongate shaft-connecting element, said means for connection allowing rotation of the club shaft about its own axis, pivoting of the club shaft in the plane of the track, and rocking of the club shaft relative to said plane.

18. The apparatus of claim 17, wherein the at least two carriage parts are each freely swingable relative to each other.

19. The apparatus of claim 17, wherein the at least two carriage parts are hingedly adjustable relative to each other.

20. The apparatus of claim 17 further comprising a height adjustment mechanism for adjusting the height of the side support means, the mechanism comprising a pair of obliquely extending beams each having a first end and a second end, the beams pivotally intersecting intermediate said ends in a scissor-like manner with the first ends horizontally opposing each other and fixed in relation to the side support means so that height of the side support means is adjusted by movement of the beams in a scissor-like manner.

21. A golf training apparatus comprising:

(i) spaced side support means mounted on base elements and height adjustable relative to the base elements;

(ii) a guide track of looped configuration pivotally mounted between the side support means, the looped configuration of the guide track having a plane and defining a golf club swing path;

(iii) means for pivotally adjusting the guide track relative to the side support means, independent of height of the side support means;

(iv) a carriage comprising at least two parts, each of said parts comprising bearing means interengaged with the looped track, and an elongate bridging part intermediate the two carriage parts;

(v) an axially adjustable elongate shaft-connecting element mounted on the bridging part, for adjustment relative to the bridging part, the bridging part comprising a tunnel through which the elongate element extends, and a means for securing the elongate element at a selected height relative to the bridging part;

(vi) means for connecting a golf club shaft onto the axially adjustable elongate shaft connecting element, said means for connection allowing rotation of the club shaft about its own axis, pivoting of the club shaft in the plane of the track, and rocking of the club shaft relative to said plane; and (vi) a height adjustment mechanism for adjusting the height of the side support means, the mechanism comprising a pair of obliquely extending beams each having a first end and a second end, the beams pivotally intersecting intermediate said ends in a scissor-like manner with the first ends opposing each other and fixed in relation to the side support means so that height of the side support means is adjusted by movement of the beams in a scissor-like manner.

* * * * *